US006036894A

United States Patent [19]

Brown et al.

[11] Patent Number: 6,036,894

[45] Date of Patent: Mar. 14, 2000

[54] MANUFACTURE OF PROPELLANT COMPOSITIONS AND PROPELLANT CHARGES

[75] Inventors: Robert James Brown, London; Ernest Melville Guthrie Cooke, Cheshunt; Graham James Spickernell, Aylesbury; Arthur Ronald Treadgold, London; Bernard George Tucker, Saffron Waldon, all of United Kingdom

[73] Assignee: The Secretary of State for Defence in her Brittanic Majesty's Government of the United Kingdom of Great Britain and Northern Ireland., London, United Kingdom

[21] Appl. No.: 06/500,628

[22] Filed: May 27, 1983

[30] Foreign Application Priority Data

May 28, 1982 [GB] United Kingdom ..... 8215652

[51] Int. Cl.[7] ..... G06B 21/00

[52] U.S. Cl. ..... 264/3.1; 149/19.4; 149/19.9; 149/19.92

[58] Field of Search ..... 149/19.9, 19.92, 149/19.4; 264/3.1

[56] References Cited

U.S. PATENT DOCUMENTS

| | | | |
|---|---|---|---|
| 3,296,043 | 1/1967 | Fluke et al. | 149/19.92 |
| 4,069,365 | 1/1978 | Rembaum | 428/262 |
| 4,092,189 | 5/1978 | Betts | 149/19.92 |
| 4,156,700 | 5/1979 | Tremblay et al. | 149/19.9 |
| 4,196,129 | 4/1980 | Rhein et al. | 260/346.3 |
| 4,337,103 | 6/1982 | Elrick et al. | 149/19.9 |

*Primary Examiner*—Edward A. Miller
*Attorney, Agent, or Firm*—Cushman Darby & Cushman IP Group of Pillsbury Madison & Sutro LLP

[57] ABSTRACT

This invention relates to the manufacture of composite propellants containing rubbery binders and particulate non-binder ingredients. The process consists of curing a mixture of a functionally-terminated hydro-carbon prepolymer and a cross-linking agent to form a viscoelastic first binder composition, mixing the binder with non-binder ingredients to form a plastic propellant, and rubberising at least a part of the plastic propellant by adding to it a further quantity of the cross-linking agent, provided the propellant is formed into a propellant charge while still in a plastic state. The further quantity of the cross-linking agent may be mixed in with the plastic propellant prior to forming, or applied to the surface of the plastic propellant after having been formed into a charge.

In a preferred embodiment of the invention, the prepolymer consists of an hydroxy-terminated polybutadiene having a molecular weight of about 3000 and a functionally of about 2.2, and the cross-linking agent consists of isophorone diisocyanate.

18 Claims, 2 Drawing Sheets

MANUFACTURE OF PROPELLANT COMPOSITIONS AND PROPELLANT CHARGES

This invention relates to a composite propellant compositions and manufacturing processes therefor, which compositions contain solid particulate oxidant and generate gases as products of self-combustion. Such compositions may be used in rocket motors, engine start cartridges, gas generators and like devices.

Processes for manufacturing solid composite propellant charges are known whereby solid particles of non-binder propellant ingredients are intimately mixed with adhesive binders and subsequently formed into desired shapes. The properties of the binder dictate to a large extent the means which may be used to form the propellant charges. Many of the previously known binders consist of visco-elastic liquids, that is to say "Bingham" materials whose response to stress conform to the superposition of elements which obey Hooke's elastic law and elements which obey Newton's viscosity law. These liquid binders enable a propellant in which they are incorporated to be formed easily into desired shapes using simple dynamic forming techniques eg extrusion, in which external pressure is applied to the propellant to force it through a die. At the same time, these liquid binders usually impart some mechanical strength to the propellant composition, enabling them to retain their shape once formed, but these compositions do tend to undergo plastic deformation over long periods of time, particularly if their formed mass is high which is a particular disadvantage in applications where the shape of the propellant composition has a significant effect on its performance once fired.

The mechanical strength of propellants may be significantly improved by using elastic binders. An optimised combination of elasticity and strength is particularly important in rocket motors, where, in use, the propellant must retain a certain elasticity even at very low temperatures (eg −55° C.) to be able to withstand and recover from high acceleration forces without suffering permanent deformation or fracture. By careful control of propellant manufacture, these optimised combinations of physical properties may be achieved using known curable binders comprising combinations of hydrocarbon prepolymers and cross-linking agents which are mixed in with the non-binder propellant ingredients and are allowed to cure at elevated temperatures to an elastic solid.

Some of the most favoured hydrocarbon prepolymers used in these applications are liquids at room temperature and consist of high molecular weight, functionally-terminated polybutadienes of which hydroxy-terminated polybutadiene (HTPB), carboxy-terminated polybutadiene (CTPB) and carboxy-terminated polybutadiene/acrylonitrile (CTBN) are examples. Some of the main advantages of these liquid prepolymers in the manufacture of composite propellants are as follows:

1. The polybutadiene background provides the propellant with excellent elasticity at low temperatures. This is extremely important to prevent brittle failure of the charge caused by very high gravitational forces produced at or soon after the launch of the rocket.
2. These prepolymers are curable at relatively low temperatures, typically below 100° C.
3. The viscosity of these prepolymers are low at typical propellant processing temperatures (usually about 60° C.) which means that propellant ingredients may be intimately mixed using relatively light duty equipment.

HTPB is an especially preferred prepolymer for many composite propellant compositions, because it is relatively cheap, available as a liquid at room temperature, and is easily manufactured in a highly pure state (unwanted binder by-products are particularly unwelcome in propellant manufacture because of their often deleterious and highly unpredictable effects on the mechanical and ballistic characteristics of the propellant).

However, propellants incorporating curable binders have a disadvantage over those containing visco-elastic liquids in that they are not generally easily formed into desired shapes using simple dynamic techniques eg extrusion. This is because, as the binder cures, the viscosity of the propellant is usually either too low at the beginning of binder cure or too high and too elastic after extensive cross-linking has set in to allow extrusion to be used. This advantage generally limits the method by which propellant charges containing curable binders may be formed to casting, in which the propellant is poured into a cast of desired shape when in a fluid, precured state, and the cast is then placed in a curing oven for a period of time (typically one week) to effect a complete cure of the binder before the cast is removed.

Casting as a technique of forming propellant charges, though often attractively simple, introduces many disadvantages that are not experienced with extrusionor other dynamic forming techniques, mainly by its very nature casting dictates to a large extent the range of physical properties of the propellant charges which it can produce. For example the particle size and shape of the non-binder propellant ingredients must be carefully controlled in order to ensure that the propellant pours easily into the cast but without allowing the particles to settle out in the uncured binder, and this limitation may adversely affect the ballistic properties of the propellant when cured. These disadvantages are particularly acute when manufacturing high performance, high burning rate charges, where it is necessary to load typically in excess of 70% by weight oxidant particles of very fine particle size into the propellant. The minimum average particle size of oxidant used in composite propellants to produce high burning rate is of the order of 1 to 4 microns, which is approximately the minimum achieveable by the mechanical attrition of large particles by micronization. However, it is not possible to include more than about 20 to 40% by weight of these micronized particles in a propellant charge formed by casting, because even when using a high proportion (in excess of 20%) of an uncured liquid binder of relatively low viscosity, the composition is too viscous to pour into a casting mould. This necessitates the use of very expensive burning rate catalysts to bring about a significant increase in burning rate. An examle of such a catalyst which has been used in composite propellants is n-hexylcarborane, which is an extremely expensive material made from highly toxic, inflammable, and dangerous reactants.

A further disadvantage of the use of curable binders in the manufacture of propellant charges by known processes is that the ballistic properties of the propellant can only be tested once the binder is cured to an elastic solid. Once the binder is cured the composition may not be altered, so that a cured composition which is found to possess ballistic or other properties outside an acceptable, specified range must be rejected. This is a particular disadvantage where a very close control of propellant burning rate is required, which can lead to a high proportion of propellant charges being rejected as unsuitable.

It is an object of the present invention to provide a propellant composition and a manufacturing process therefor whereby the above disadvantages are overcome or at least partially mitigated, thereby rendering a propellant containing a curable binder more suitable for forming by dynamic techniques such as extrusion.

Accordingly, the present invention provides a plastic propellant composition comprising, in admixture, a viscoelastic fluid binder compounded from a functionally—terminated hydrocarbon prepolymer and a first quantity of a cross-linking agent, and solid particulate propellant ingredients, said binder being curable, after the addition of a second quantity of the cross-linking agent to said composition, to a substantially non-flowing elastic state.

The present invention further provides a process for the manufacture of a plastic propellant composition, comprising the steps of curing a mixture of a prepolymer and a first quantity of a cross-linking agent to form a viscoelastic fluid binder, which binder is further curable to a substantially non flowing elastic state after the addition of a second quantity of the cross linking agent, and mixing the binder with solid particulate propellant ingredients to form the composition. Alternatively, the process may involve a single process step by curing the prepolymer and the first quantity of the cross-linking agent in the presence of the propellant ingredients.

The plastic propellant composition of the present invention may subsequently be used to manufacture a rubbery propellant composition, by admixing a second quantity of the cross-linking agent into the plastic composition sufficient to convert the viscoelastic binder into a substantially non-flowing elastic state, and subsequently curing the plastic composition. After the admixture of the second quantity of the cross-linking agent, the propellant composition is conveniently dynamically formed into a propellant charge while the curing composition is still in a plastic state, preferably after first deaerating in vacuo and consolidating the curing composition whilst in a plastic state. Extrusion, press forming, and injection moulding are dynamic forming techniques well known in the plastic propellants and which may be employed to form the charge.

Alternatively, the plastic propellant composition of the present invention may subsequently be used to manufacture partially—rubberized propellant charges, by dynamically forming the plastic composition into the shape of the charge, then applying to the surface of the charge shape a second quantity of the cross-linking agent sufficient to convert the viscoelastic binder at the surface of the charge shape into a substantially non-flowing elastic state when cured, and subsequently curing the binder at the surface of the charge shape. The plastic composition is preferably deaerated in vacuo and consolidated prior to dynamic forming into the charge shape, and a convenient method of applying the second quantity of the cross-linking agent is first to dissolve the second quantity in a solvent, then to spray the cross-linking agent in the solvent onto the surface of the charge shape, and finally to evapourate the solvent from the surface of the charge shape.

A plastic propellant composition in accordance with the present invention, and a rubbery propellant composition manufactured therefrom, will generally contain at least the below listed ingredients (% by weight):

| | | |
|---|---|---|
| Hydrocarbon fuel | 0–10% | preferably 0% |
| Metallic reducing agent | 0–24% | preferably 0–15% |
| Micronised oxidant | 0–85% | preferably 40–80% |
| Non-micronised oxidant | 0–90% | preferably 0–40% |

-continued

| | | |
|---|---|---|
| Coolant | 0–50% | preferably 0% |
| Burning rate catalyt | 0–2% | preferably 0% |
| Binder (total) | 5–25% | preferably 12–15% |

The above ingredients excluding the binder comprise the solid particulate propellant ingredients. Generally the combined weight of oxidant and coolant will be 65–90%, preferably 70–88% (by weight) of the total composition.

The term "micronised" as used in this specification means particles having an average particle size of between 1 and 4 microns: accordingly "non-micronised" means particles having an average particle size in excess of 4 microns, though preferably less than 50 microns.

Of the solid particulate propellant ingredients, the metallic reducing agent is preferably aluminium, the oxidant (including micronised oxidant) preferably ammonium perchlorate and or ammonium nitrate, the coolant preferably ammonium picrate and/or oxamide and the hydrocarbon fuel preferably polyethylene. The burning rate catalyst may be a combination of one or more compounds such as copper oxide, iron oxide, copper chromate, chromium sesquioxide and may be added to increase burning rate of the propellant. Further ingredients which may be added include silica to improve the regularity of burning in general, an anti oxidant such as 2, 2' methylene-bis (4-methyl-6-t-butyl phenol), which assists in the long term preservation of the propellant, and a bonding agent, such as an imine, to improve bonding between the binder and the particulate ingredients.

The apparent viscosity of the binder portion of a plastic propellant composition containing particulate ingredients within the general ranges specified above, is preferably between 2,000 poise and 20,000 poise at 25° C. as measured by the Falling Sphere Viscometer Method described in British Standard Specification 188 Section 3 (1977).

The functionally-terminated hydrocarbon prepolymer preferably comprises hydroxy-terminated polybutadiene (HTPB) and the cross-linking agent preferably comprises an organic diisocyanate. The HTPB preferably has an average functionality of between 2 and 3, most preferably between 2.1 and 2.5, and is conveniently a liquid at room temperature. The organic diisocyanate is preferably isophorone diisocyanate (IPDI), which is a liquid at room temperature and undergoes a relatively slow curing reaction with HTPB at temperatures between 20° C. and 60° C., which is advantageous for the present process.

The physical properties of a binder comprising a mixture of HTPB and IPDI depends on the percentage content of the butadiene and isocyanate within the mixture. The content of such a binder is generally given by reference to the equivalents of IPDI present in the binder. When the binder contains a mixture of IPDI and HTPB in which the number of isocyanate groups (from IPDI) is equal to the number of hydroxyl groups (from HTPB), then the composition is said to contain one equivalent of IPDI. The number of IPDI equivalents is directly proportional to IPDI concentration in the binder.

As IPDI concentration in a cured HTPB/IPDI binder is increased, it is found that the properties of the binder change from a viscous liquid to a visco-elastic fluid and finally to an elastic solid. It is believed, although the invention is not limited in any way by this explanation, that up to an IPDI content of about 0.7 equivalents in the binder, the IPDI reacts with the HTPB to cause chain extension of the HTPB molecules, hence the cured binder exhibits viscous or visco-elastic fluid properties. Above 0.7 equivalents IPDI, the chain-extended HTPB molecules are believed to form a gel and the effects of additional IPDI is to increase the cross-link density between HTPB molecules, which imparts rubbery qualities to the cured binder.

It has been found that a cured binder having an IPDI equivalents content of less than about 0.5 is not sufficiently visco-elastic to form a propellant composition into a cohesive, plastic state, whereas above an IPDI content of about 0.65 the propellant composition is very stiff and undergoes plastic deformation only with great difficulty. Similarly, a rubbery propellant composition containing less then 0.75 equivalents of IPDI is found to have an undesirably low tensile strength once cured, and an excess of IPDI (ie where the equivalents exceeds 1.0) forms an unwanted contaminant in the propellant composition.

The average molecular weight of the HTPB is preferably between 1,000 and 10,000, and is most preferably about 3,000. Below a molecular weight of about 1,000, it is believed that HTPB/isocyanate copolymers are generally too brittle to be used as binders in rubbery propellant compositions, because the polybutadiene portions of the copolymers are too short to provide the copolymers with adequate flixibility, particularly at low temperatures. Above a molecular weight of about 10,000, it is believed that chain extension of the HTPB by a first quantity of an isocyanate cross-linking agent would produce a binder having a viscosity which would be too high at typical safe propellant processing temperatures of 20–80° C. to mix easily with and adequately wet the solid particulate ingredients without the expenditure of a great deal of time and mixing energy. An HTPB having an average molecular weight of about 3,000 not only has a low viscosity at room temperature and is thus easily mixable with a first quantity of an isocyarate cross-linking agent, but also can produce a range of isocyanate copolymers which have desirable rubbery properties.

For a plastic propellant composition containing less than 0.65 equivalents IPDI in the viscoelastic fluid binder and no burning rate catalyst such as copper chromate or other such compound that may subsequently catalyse the curing of the binder after the addition of the second quantity of (IPDI), the second quantity of cross-linking agent comprising IPDI is advantageously added to and intimately mixed in with the whole of the plastic propellant composition. Provided the subsequent processing temperatures is maintained at 60° C. or below, this allows at least 2 hours after the addition of this second quantity before extensive cross-linking of the HTPB molecules makes the propellant too stiff to undergo plastic deformation. After this period of time, dynamic forming also causes appreciable permanent fracture damage to the propellant composition. Processing may proceed for 24 hours or more by using a viscoelastic binder in the plastic propellant having an IPDI content of less than 0.6 equivalents, and by reducing the processing temperature of the propellant composition after the addition of the second quantity of IPDI to 35° C. or less. Alternatively, the propellant compositions where the onset of binder cross-linking in the second stage of curing cannot readily be delayed eg where the propellant composition includes a burning rate catalyst such as copper chromate, the second quantity of cross-linking agent comprising IPDI may be first dissolved in a suitable solvent, such as acetone, and then sprayed onto the surface of a formed shape of the plastic propellant composition, to provide a propellant composition which contains a rubbery binder within a surface portion only.

The main advantage of the present invention is that it provides a simple process by which a composite propellant composition containing a curable binder may be formed by extrusion or other dynamic forming techniques (such as pressing). The propellant may be stored for several months in an intermediate plastic state. This enables quality control checks on the propellant composition (such as content, density and ballistics) to be made before the propellant is mixed with further cross-linking agent and is formed into a final shape and cured. The plastic properties of the intermediate means that any batches of intermediate found not to meet a desired propellant specification may be re-mixed with other propellant constituents or blended with other intermediate batches rather than be rejected altogether. By employing the present process, propellant compositions may be formed into propellant charges by using only one former or die rather than a multiplicity of casting moulds. This enables considerable savings in production equipment costs to be made. The present invention does not require the use of so costs to be made. The present invention does not require the use of solid ingredients which are specially prepared or blended to improve the flow characterists of the propellant prior to curing. As an example, spheroidal aluminium particles, commonly used in cast propellant technology, are not required. As a further example, it is not necessary to grade the particle sizes of the solid ingredients so as to minimise the viscosity of the propellant composition prior to curing, although it is desirable to include more than one range of oxidant particle sizes where a high oxidant level (generally in excess of 75%) in the propellant is required.

The present invention is particularly advantageous for the manufacture of propellant compositions containing more than about 20 to 40% by weight micronized oxidants. We have found that high performance propellant compositions containing up to approximately 80% by weight micronized ammonium perchlorate may be manufactured by the present process, giving buring rates at 7 MPa up to 50 $mm^{-1}s$ without the use of any burning rate catalyst. The number of ingredients used in both these and lower burning rate propellant compositions are small, making predictions of physical and ballistics properties much easier than for compositions containing a variety of catalysts, plasticisers and the like.

Examples of dynamic forming techniques which may be used to form the propellant composition manufactured by the present process into propellant charges are extrusion, press forming, and injection moulding. These forming techniques are all well known in the plastic propellant art.

Plastic and rubbery propellant compositions, and processes for the manufacture thereof in accordance with the present invention will now be described by way of example only with reference to the accompanying drawings.

BRIEF DESCRIPTION OF THE DRAWINGS

In the processes described below, cured mixtures of a hydrocarbon prepolymer comprising HTPB and a cross-linking agent comprising IPDI were used as binders for propellant compositions. FIG. 1 illustrates experimental results of tests conducted on various cured mixtures of HTPB and IPDI containing known concentrations of hydroxyl groups and isocyanate groups respectively. Each experimental mixture was cured for one week at 60° C., and its apparent viscosity then measured at 25° C. by the Falling Sphere Viscometer Method of British Standard Specification 188, 1977.

Figure 1:
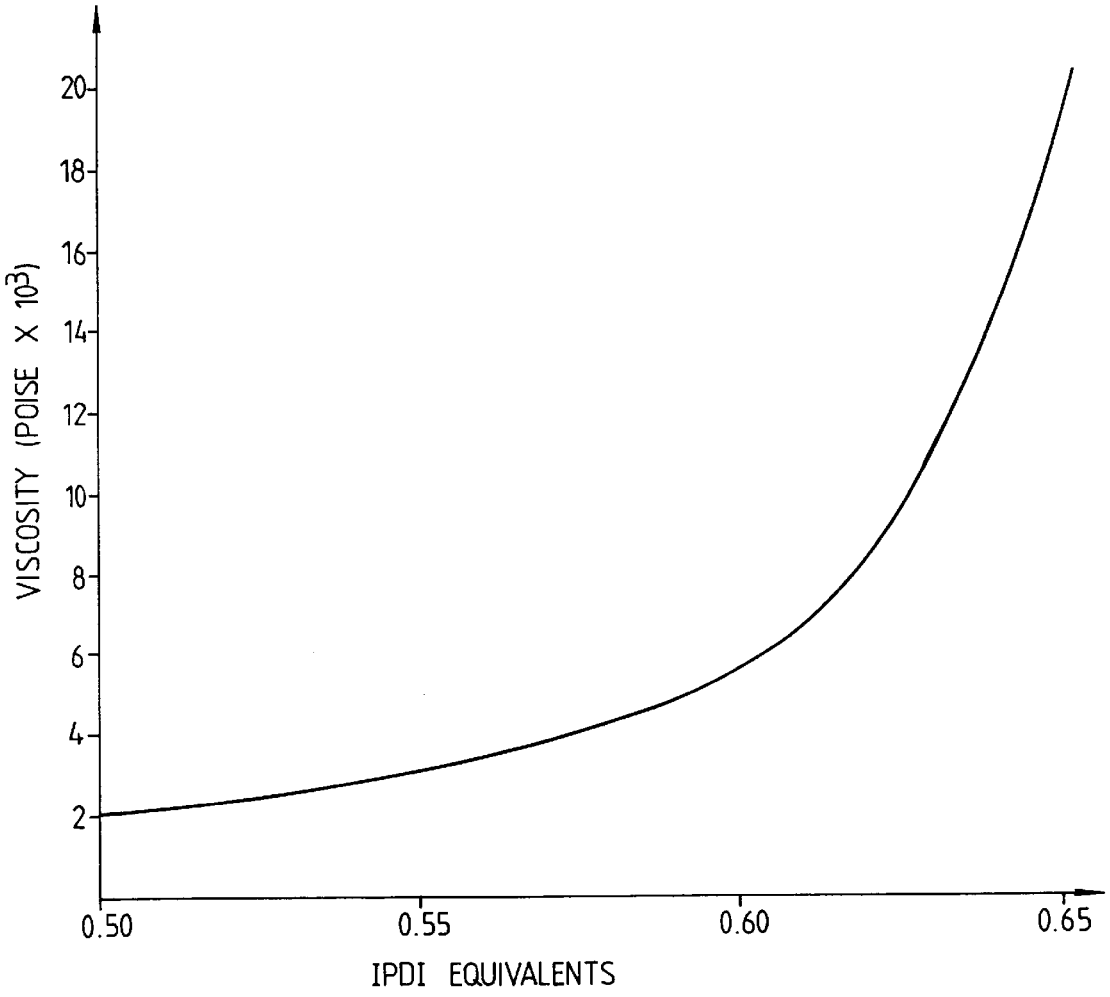
FIG. 1 illustrates an approximate graphical representation of IPDI concentration in the first binder composition (in terms of the equivalents of IPDI to HTPB) against the apparent viscosity of the cured binder composition at 25° C. as measured by a Falling Sphere Viscometer.

The IPDI and HTPB used in the process Examples below were both of commercial grades, and in practice some batch-to-batch variation in the concentration of functional groups (ie isocyanate groups and hydroxyl groups) contained in each was known to occur. The HTPB used in the process Examples was Prepolymer R45M, which has a functionality of about a 2.2, a molecular weight of about 3,000, and is manufactured by ARCO Chemical Company of the USA, and the IPDI used was an approximately 98% pure commercial grade. Small variations in functional group concentration within each compound were found to give rise to large variations in cured binder viscosity indicated in FIG. 1 and so it was found necessary to first calibrate paired bulk quantities of HTPB and IPDI before use of these compounds from these bulk sources in the process Examples. This calibration entailed conducting laboratory-scale viscosity tests at 25° C. on a number of cured, viscoelastic binder mixtures of known composition (by weight) which were prepared from these bulk sources. An indication of the approximate IPDI equivalents content of these mixtures could be obtained by reference to FIG. 1. The approximate IPDI equivalents content and expected viscosity of other cured mixtures from these bulk sources could thus be predicted from the amount of each compound used in the mixtures.

EXAMPLE 1

100 Kg batches of each of the 3 propellant compositions given in Table 1 below were prepared from the following constituents.

TABLE 1

| | Weight in kg | | |
|---|---|---|---|
| Constituents | Propellant A | Propellant B | Propellant C |
| 2 micron AP* | 42.9 | 52.4 | 59.9 |
| 7.5 micron AP* | 31.9 | 22.4 | 14.9 |
| Aluminium | 12.0 | 12.0 | 12.0 |
| Antioxidant | 0.1 | 0.1 | 0.1 |
| Bonding agent | 0.1 | 0.1 | 0.1 |
| Binder | 13.0 | 13.0 | 13.0 |
| Burning rate @ 7 MPa | 39.2 | 41 | 42.2 |
| Burning rate @ 30 MPa | 91.7 | 101 | 107 |

*AP = Ammonium Perchlorate

Each of the constituents listed in Table 1 above were prepared or obtained in the following form:

Ammonium Perchlorate (AP) of 7.5 micron nominal particle size was prepared by feeding a high purity, low water content, military-specification ammonium perchlorate powder (preferably containing up to 0.5% tricalcium phosphate or alumina anti-caking agent) into a Minikek Involute Pin-Mill under dry atmospheric conditions. The settings on the Mill were approximately adjusted to produce AP of the desired particle size. The particle size of the product AP was checked in a Fisher Sub-Sieve Sizer, which measures particle size in terms of the specific surface (Sv) in $cm^2/cm^3$. The 7.5 micron AP was known to correspond to an Sv of 8,000 $cm^2/cm^3$. After milling, the AP was dried for 24 hours in an oven at 85° C. AP of 2 micron nominal particle size (which is termed micronized AP-MAP) was prepared from a similar high purity AP powder, which was broken down in a 300 mm diameter fluid energy mill, using dry air, at 0.3 MPa and 80° C., as the carrying medium for the powder. The MAP was then dried for 24 hours in an oven at 85° C. prior to use.

The aluminium used in the above propellants A, B and C was a chemically pure, atomized, heavy grade, non-spheroidal aluminium powder having an Sv of about 3,500 $cm^2/cm^3$.

The above propellant compositions all included minor quantities of an anti-oxidant, to improve the long-term stability of the composition, and a bonding agent, to assist in the wetting of the particles of the non-binder ingredients (ie mainly AP or AP and aluminium) by the binder ingredients. The anti-oxidant used was 2,2'-methylene-bis (4-methyl-6-t-butyl phenol), hereinafter referred to as "2246", and the bonding agent was a liquid imine well known in the composite propellants art, which is prepared by reacting tris [1-(2-methyl)aziridinyl] phosphine oxide (MAPO) with lactic acid at a maximum temperature of 60° C. under controlled conditions, in the molar ratio of 1:1.

100 kg batches of each of the Propellants A, B and C listed in Table 1 above were prepared by the following process.

About 13 kg of a fluid binder containing a mixture of R45M HTPB prepolymer and 98% pure commercial grade IPDI was made up in the proportion about 50 grammes of 98% IPDI per kilogram R45M. The two binder ingredients were heated to 60° C. and poured into a vertical mixer, which was then sealed and evacuated to a pressure of 200 mm of mercury to discourage the ingress of air during mixing. Mixing then proceeded for one hour, after which the seal was broken, and the contents of the mixer stored in a container for one week at 60° C. to effect complete cure. The exact quantities of each of R45M and 98% IPDI binder ingredients used was determined from mixture calibrations of the bulk sources of these two compounds such that the predicted apparent viscosity of the binder when cured to a viscoelastic fluid would be 5,000±1,000 poise at 250° C. as determined by the Falling Sphere Viscometer Method. (This corresponds to an IPDI equivalents content of about 0.6 from FIG. 1).

After curing, about 12.7 kg of the viscoelastic binder was heated to 80° C. and placed in a stainless steel heavy duty horizontal incorporator, having twin heavy duty masticating blades and a water-jacketed mixing bowl. Such incorporators are well known in the plastic propellants art. The binder was then mixed in the bowl at a blade speed of 20 revolutions per minute (rpm) and the particulate ingredients were slowly added. The resultant plastic propellant composition was mixed for a further 2 hours until the non-binder ingredients were fully wetted and the mixture fully homogenised. The composition was then scraped from the incorporator and transferred to the rotary pugmill 1 illustrated in FIG. 2.

Figure 2:
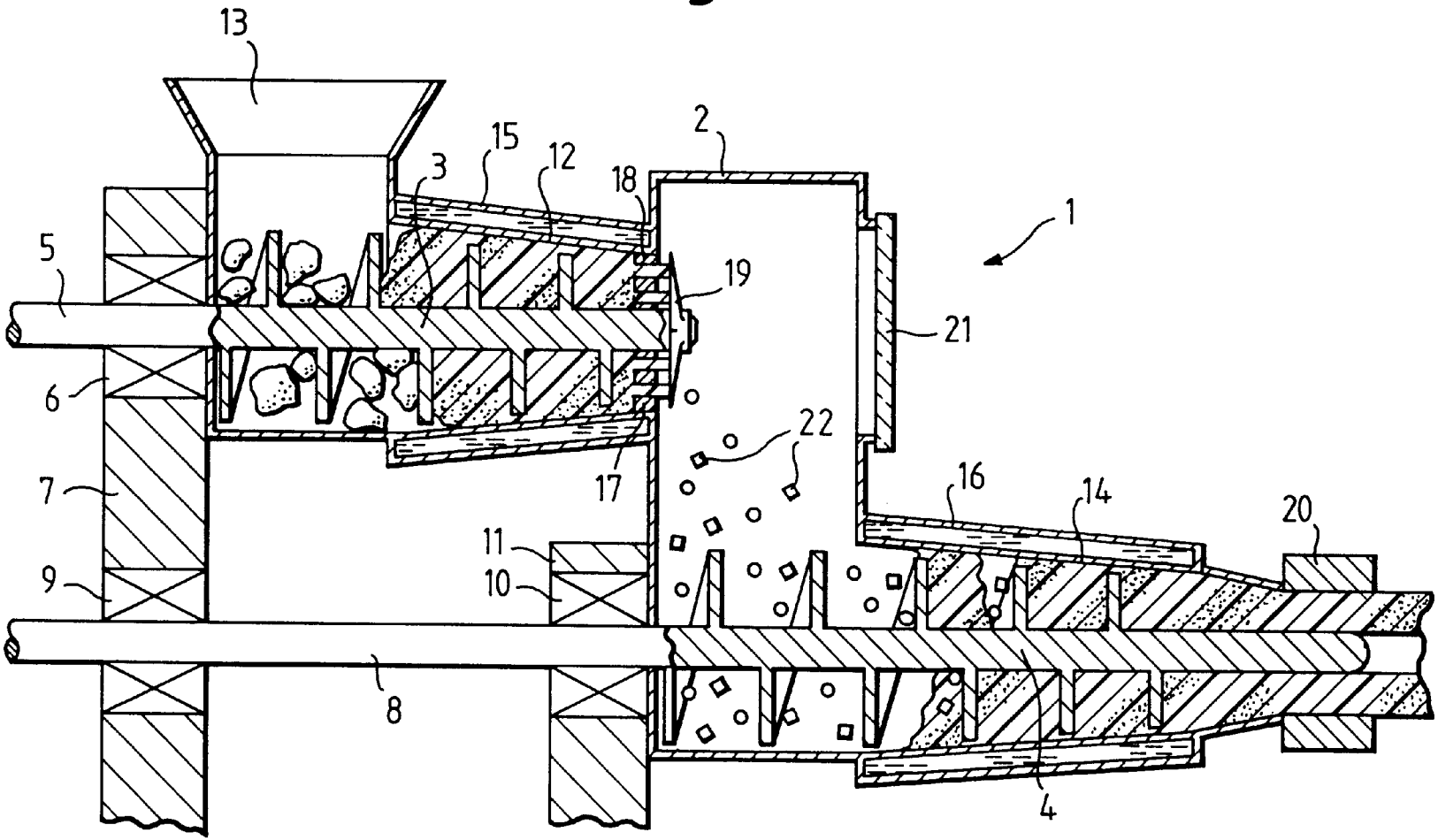
FIG. 2 represents a plan view in section of a deaerating pugmill for consolidating and deaerating a propellant composition when in a plastic state.

The deaerating pugmill 1 of FIG. 2 is of similar design to those used by the clay working indsutry to deaerate and consolidate clays, but the former is manufactured from materials and to a standard which enables it to handle hazardous materials such as plastic propellants. The pugmill 1 consists of a vacuum chamber 2 which is open adjacent its top end to receive an upper horizontal screw conveyor 3. A lower horizontal screw conveyor 4 passes through the lower end of the vacuum chamber 2. The upper screw conveyor 3 is mounted on an upper shaft 5 supported on a first bearing 6 within a first housing 7. The lower screw conveyor 4 is mounted on a lower shaft 8 which in turn is supported by a second bearing 9 within the first housing 7, and a third bearing 10 in a second housing 11. The upper screw conveyor 3 is housed within a funnelled inlet pipe 12 to the chamber 2, which pipe is connected to a feed hopper 13. The lower screw conveyor 4 is housed within a funnelled outlet pipe 14 from the chamber 2, which channels into a circular die 20. The inlet pipe 12 and the outlet pipe 14 have hot water jackets 15 and 16 respectively. All the internal components of the pugmill 1 are made of stainless steel and are electrically earthed. Rubber seals (not shown) are situated at all internal stationary and moving metal-to-metal interfaces to prevent metal parts rubbing against one a nother. The forward end 17 of the upper screw conveyor 3 passes through a shredder plate 18 mounted within the inlet pipe 12. Mounted on the forward end 17 adjacent the plate 18 is a triple blade knife 19. A perspex inspection window 21 is situated on the vacuum chamber 2 to give a clear view of the knife 19.

In operation, pieces of the plastic propellant composition from the incorporator are fed into the feed hopper 13. The rotating upper screw conveyor 3 forces the propellant into the inlet pipe 12, through the shredder plate 18, and into the vacuum chamber 2 which is maintained at an absolute pressure of 2 mm of mercury or less. The temperature of the inlet pipe 12 is maintained at 60° C. by the water jacket 15. When the thin cords of propellant emerge through the shredder plate 18 into the vacuum, the rotating knife 19 cuts the propellant into short pieces 22. The short pieces 22 are deaerated in the vacuum and fall to the bottom of the vacuum chamber 2 where the rotating lower screw conveyor 4 consolidates the propellant in the outlet pipe 14 maintained at 60° C. by the water jacket 16, and passes it through the die 20 to atmospheric pressure.

The plastic propellant composition was dearated and consolidated by the pugmill 1 in accordance with the above procedure, and was then cooled to room temperature and stored in water-tight containers. It was found that this composition could be stored for several months without deteriorating or hardening. Samples of this composition were tested at leisure to check the composition's ballistic and physical properties.

The plastic propellant compositions of Propellants A, B and C behaved as cohesive immobile plastics at room temperature and up to a temperature of at least 80° C. By placing a first sample of each composition into an hydraulic press at 25° C., it was found that the intermediate propellant composition was sufficiently fluid to extrude at a rate of at least 5 mm per second through a tube of 1.75 mm diameter and 17.5 mm long mounted in a capillary extrusion rheometer, without exceeding a pressure of 70 MPa within the rheometer. The ballistics of each composition were checked to see if they conformed to specified propellant burning rates, by taking samles of the compositions and firing them in model rocket motors. The plastic behaviour of the plastic propellant compositions of propellants A, B and C rendered them suitable for blending with other, similar compositions prepared in accordance with the present invention in the horizontal incorporator. Blending allowed very close control of burning rate of the plastic propellant compositions (to within ±2%) to be achieved.

After conducting the above tests and storing and blending the plastic propellant composition as required, it was transferred back into the incorporator. The composition was kneaded for 15 minutes in the mixing bowl of the incorporator at a temperature not exceeding 50° C., and a further quantity of 98% IPDI was added until there was about 20 grammes IPDI per kilogram R45M in the plastic propellant composition. This corresponded to about 0.3 kg 98% IPDI per 100 kg of plastic propellant composition. The amount of 98% IPDI that was to be added in this second stage was calculated on a pro-rata basis to increase the amount of IPDI present in the viscoelastic binder from an assumed 0.6 equivalents to 0.85 equivalents in the second stage of the process. Thus the amount of IPDI ($W_2$) to be added in the second stage was calculated by the formula $$W_2 = X.W_1$$

where $$X = \frac{0.85 - 0.6}{0.6} = 0.4188,$$

and $W_1$=the weight of IPDI present in the viscoelastic binder. Kneading continued for a further 15 minutes until the further IPDI was fully mixed into the composition. The resulting propellant composition was then immediately scraped from the incorporator and deaerated in the deaerating pugmill. The deaerated and consolidated propellant composition was then ready to be formed into propellant charges.

It was found that the propellant composition remained sufficiently plastic at 50° C. to be processed into propellant charges for up to 6 hours. Furthermore, it was found that by maintaining the temperature of the composition at 25±5° C., the composition could be processed for 24 hours or more before the composition became too stiff due to the further curing of the binder. After forming the composition into propellent charges by forming techniques such as extrusion, press-forming or injection moulding well known in the plastic propellants art, the charges were fully cured for 3 days at 60° C.

All the propellant compositions prepared by the above method exhibited rubbery properties once cured. Their typical physical properties are listed in Table 2 below. Their ballistic properties, listed in Table 1 above, were identical to those of their corresponding plastic propellant compositions.

TABLE 2

| | Tensile properties of Propellants A–C inclusive | | |
|---|---|---|---|
| | +60° C. | +25° C. | −50° C. |
| Tensile strength, in MPa | 0.8 | 1.0 | 10.0 |
| Elongation at Rupture, in % | 40 | 35 | 15 |
| Modulus of Elasticity, in MPa | 2.2 | 4 | 90 |

EXAMPLE 2

A 100 kg batch of Propellant D was manufactured in accordance with the process of Example 1, except that about 15 kg of the viscoelastic binder was made up in the vertical mixer, and about 14.5 kg of the composition when cured was used to make up the plastic propellant composition. Furthermore, the exact quantity of further 98% IPDI added after deaerating and optionally blending the plastic propellant composition, was calculated by the method given in Example 1 such that the IPDI content of the viscoelastic binder was increased to about 0.80 (x=0.3333). The composition of Propellant D is given below:

| Constituent | Weight in kg |
|---|---|
| 2 micron AP | 80 |
| 7.5 micron AP | 4.9 |
| Antioxidant | 0.1 |
| Bonding agent | 0.2 |
| Binder | 14.8 |

The physical properties of the propellant composition once cured and the plastic propellant composition were found to be very similar to those of Propellants A, B and C prepared by the process of Example 1. Propellant D was found to have a burning rate of 47.8 $mms^{-1}$ at 7 MPa and 110 $mms^{-1}$ at 30 MPa.

EXAMPLE 3

A 100 kg batch of a Propellant E of identical composition to Propellant B of Example 1 was manufactured in accordance with the process of Example 1 above, except that the viscoelastic binder was made up in the proportion of about 45 gm of 98% IPDI per kilogram R45M, and the propellant composition itself was made up by adding a further quantity of 98% IPDI to the intermediate propellant composition in the proportion of about 32 grammes 98% IPDI per kg R45M. The exact quantity of 98% IPDI added during the process were calculated by the methods described in Example 1 such that the viscoelastic binder had an apparent viscosity at 25° C. of 4,000±1,000 poise, corresponding to an IPDI equivalents content of about 0.55, and such that the propellant composition had an IPDI equivalents content of about 0.93 (x=0.6909) after the second stage.

The plastic propellant composition of Propellant E prepared by the process of Example 3 was found to behave as a cohesive immobile plastic to a temperature of at least 80° C., similar to the corresponding composition of Propellant B prepared by the process of Example 1. The ballistic properties of Propellant E once formed into a propellant charge were found to be virtually identical to those of Propellant B. The physical properties of Propellant E once fully cured are given in Table 3 below:

TABLE 3

| | Tensile properties of Propellant E | | |
|---|---|---|---|
| | +60° C. | +25° C. | −50° C. |
| Tensile strength, in MPa | 1.4 | 1.6 | 12 |
| Elongation at Rupture, in % | 23 | 23 | 13 |
| Modulus of Elasticity, in MPa | 6 | 8 | 100 |

EXAMPLE 4

A 100 kg batch of a Propellant F was manufactured in accordance with the process of Example 1, except that the propellant composition was made up by adding a further quantity of IPDI to the plastic propellant composition in the proportion of about 34 grammes of 98% IPDI per kilogram R45M. The exact further quantity of 98% IPDI added was calculated by the method described in Example 1 such that the IPDI equivalents content of the binder was increased to about 1 (x=0.6667). The composition of Propellant F is given below:

| Constituent | Weight in kg |
|---|---|
| 30 micron AP (Sv = 2000 $cm^2/cm^3$) | 75 |
| Oxamide | 8 |
| 2246 | 0.1 |
| Fumed silica powder | 2.0 |
| Lamp Carbon Black | 0.8 |
| Binder | 14.0 |

The 30 micron nominal particle size AP was prepared in the Minikek Pin-Mill described above, and was dried for 24 hours at 85° C. before use.

As with Propellants A to E inclusive, prepared by the processes of Examples 1, 2 and 3) the plastic propellant composition of Propellant F behaved as a cohesive immobile plastic at temperatures up to 80° C. and once mixed with the further quantity of IPDI was processable for up to 6 hours at 50° C. and 24 hours or more at 25° C. The burning rate of Propellant F was measured at 11.5 mm per second at 7 MPa and its pressure exponent was measured at 0.44. At 25° C., its tensile strength was measured at 1.7 MPa, its modulus of elasticity at 2.5 MPa, and its elongation at rupture at 22%.

EXAMPLE 5

A 100 kg batch of a Propellant G was manufactured in accordance with the process of Example 4. The composition of Propellant G was identical to Propellant F except that instead of containing 75 kg 30 micron AP, it contained 65 kg 30 micron AP and 10 kg polyethylene powder, a solid hydrocarbon fuel. Propellant G was therefore appreciably more fuel-rich than Propellant F. The burning rate of Propellant G was measured at 7 mm $s^{-1}$ at 7 MPa, and its pressure exponent was measured at 0.45. At 25° C., its physical properties were virtually identical to those of Propellant F.

EXAMPLE 6

A 100 kg batch of a propellant having a composition identical to Propellant B of Example 1 above, was prepared in accordance with the process of Example 1 except that the incorporator was vacuum sealed to an absolute pressure of 2 mm of mercury or less whenever used in the process, thus rendering the use of the pugmill 1 of FIG. 2 unnecessary.

The physical and ballistic properties of Propellant G prepared in accordance with the process of Example 5 were found to be identical to those of Propellant B, prepared in accordance with the process of Example 1.

EXAMPLE 7

A 100 kg batch of a plastic propellant composition, Propellant H, was manufactured in accordance with the process for the manufacture of plastic propellant composition of Example 1, except that the viscoelastic binder was made up in the proportion of about 50–55 grammes of IPDI per kilogram R45M. The exact quantity of IPDI in the viscoelastic binder was calculated such that the binder had an apparent viscosity at 25° C. of 13,000±2,000 poise corresponding to an IPDI equivalents content of about 0.63. The composition of Propellant H was as follows:

| Constituent | Weight in kg |
|---|---|
| 2 micron AP | 41.9 |
| 7.5 micron AP | 31.9 |
| Aluminium | 12.0 |
| Copper chromate | 1.0 |
| 2246 | 0.1 |
| Bonding Agent | 0.1 |
| Binder | 13.0 |

Once prepared, the plastic propellant composition, having suitable cohesive plastic properties, was extruded at 60° C. through a die into a continuous strip 2 mm thick. The strip was cut into suitable 1 m strip portions. Onto the surface of a first batch of strip portions was sprayed a 10% solution of IPDI in acetone, distributed at a rate of approximately 200 grammes of solution per $m^2$ of strip surface. A second batch of strip portions was dipped in the IPDI/acetone solution for a short period, and drained. The two batches of strip portions were then cured for one week at 60° C. after which time they were found to have elastic solid properties. Their ballistic properties were found to be similar to those of Propellant B of Example 1.

We claim:

1. A process for the manufacture of a rubbery propellant charge which comprises the steps: of forming a plastic propellant composition comprising a solid particulate propellant and a binder forming from 5% to 25% by weight of the composition, said binder comprising a prepolymer, comprising a functionally terminated hydrocarbon chain or a co-polymer thereof, of a kind capable of being chain extended by curing into a rubbery elastomeric state, said prepolymer having been partially cured by an organic cross-linking agent so as to have an apparent viscosity in the range 2,000 to 20,000 poise at 25 degrees C.; further treating said plastic composition with a curing agent adapted to complete the cure of said binder into said rubbery state; and prior to curing of said binder by said curing agent, forming said plastic propellant composition into a propellant charge by a dynamic forming process in which said plastic propellant composition is shaped into said propellant charge.

2. A process as in claim 1 wherein said curing agent comprises a further quantity of cross-linking agent added to the plastic propellant composition prior to the dynamic forming process to effect said further curing after said dynamic forming process.

3. A process as in claim 1 wherein said curing agent comprises a further quantity of cross-linking agent which is applied to said propellant charge after said dynamic forming process.

4. A process as in claim 3 wherein said further quantity of cross-linking agent is applied to said charge by spraying said cross-linking agent in a solvent.

5. A process as in claim 3 wherein the plastic propellant composition is deaerated in vacuo and consolidated prior to said dynamic forming process.

6. A process as in claim 1 wherein said prepolymer comprises a functionally terminated polybutadiene or a co-polymer thereof.

7. A process as in claim 1 wherein said prepolymer comprises a hydroxy terminated polybutadiene.

8. A process as in claim 2 wherein said cross-linking agent and said curing agent are both an agent which comprises an organic diisocyanate.

9. A process as in claim 8 wherein the dilsocyanate is isophorone diisocyanate and the binder of the plastic propellant composition prior to said further curing comprises from 0.5 to 0.65 equivalents of isophorone diisocyanate.

10. A process as in claim 7 wherein the hydroxy terminated polybutadiene has a functionality of from 2.0 to 3.0.

11. A process as in claim 1 wherein said plastic propellant composition is formed by partially curing said binder in the absence of said solid particulate propellant and subsequently mixing said partially cured binder with ingredients of said solid particulate propellant.

12. A process as claimed in claim 1 wherein said dynamic forming process is an extrusion process.

13. A process as in claim 1 wherein said dynamic forming process is a press-forming process.

14. A process as in claim 1 wherein said dynamic forming process is an injection molding process.

15. A process as claimed in claim 9 wherein in the further curing of the plastic propellant composition said binder comprises from 0.75 to 1.0 equivalents of isophorone diisocyanate.

16. A process according to claim 1 wherein said particular propellant comprises by weight of said rubbery propellant charge 0–10% hydrocarbon fuel, 0–24% metallic reducing agent, 0–85% oxidant of average particle size between 1 and 4 microns, 0–90% oxidant of average particle size greater than 4 microns, 0–50% coolant, and 0–2% burning rate catalyst, provided the combined weight of oxidant and coolant is 65–90% by weight of said composition.

17. A process according to claim 16 wherein said particulate ingredients comprise by weight of said rubbery propellant charge 0% hydrocarbon fuel, 0–15% metallic reducing agent, 40–80% of oxidant of average particle size from 1 to 4 microns, 0–40% oxidant of particle size greater than 4 microns but less than 50 microns, 0% coolant, and 0% burning rate catalyst, provided the overall weight of oxidant and coolant is 70–88% by weight of said rubbery composition.

18. A process according to claim 16 wherein the hydrocarbon fuel is polyethylene, the metallic reducing agent is aluminium, the oxidants are selected from the group consisting of ammonium perchlorate and ammonium nitrate, the coolant is selected from the group consisting of ammonium picrate and oxamide, and the burning rate catalyst is selected from the group consisting of cooper oxide, iron oxide, cooper chromate and chromium sesquioxide.

* * * * *